US008671471B2

(12) United States Patent
Hatrick-Smith et al.

(10) Patent No.: US 8,671,471 B2
(45) **Date of Patent: *Mar. 18, 2014**

(54) BATH

(75) Inventors: John Hatrick-Smith, Auckland (NZ); David Gordon Arthur, Auckland (NZ)

(73) Assignee: Kohler New Zealand Limited, Glenfield, Auckland (NZ)

( * ) Notice: Subject to any disclaimer, the term of this patent is extended or adjusted under 35 U.S.C. 154(b) by 0 days.

This patent is subject to a terminal disclaimer.

(21) Appl. No.: 13/304,106

(22) Filed: Nov. 23, 2011

(65) Prior Publication Data

US 2012/0174311 A1 Jul. 12, 2012

Related U.S. Application Data

(62) Division of application No. 10/539,760, filed as application No. PCT/NZ03/00282 on Dec. 22, 2003, now Pat. No. 8,065,757.

(30) Foreign Application Priority Data

Dec. 20, 2002 (NZ) ..... 523321

(51) Int. Cl.
*A47K 3/02* (2006.01)

(52) U.S. Cl.
USPC ..... 4/538

(58) Field of Classification Search
USPC ..... 4/538, 567; 601/148
See application file for complete search history.

(56) References Cited

U.S. PATENT DOCUMENTS

| | | | | |
|---|---|---|---|---|
| 1,054,922 | A | 3/1913 | Kenney | |
| 2,073,307 | A | 3/1937 | Isenberg | |
| 3,967,323 | A * | 7/1976 | Serio | 4/541.3 |
| 4,572,165 | A | 2/1986 | Dodier | |
| 4,868,934 | A * | 9/1989 | Altman | 4/546 |
| 4,896,383 | A | 1/1990 | Morgan et al. | |
| 4,912,782 | A | 4/1990 | Robbins | |
| 5,010,605 | A | 4/1991 | Shiina et al. | |
| 5,276,926 | A | 1/1994 | Lopez | |
| 5,333,324 | A * | 8/1994 | Pinciaro | 4/567 |
| 5,495,627 | A | 3/1996 | Leaverton et al. | |

(Continued)

FOREIGN PATENT DOCUMENTS

| | | |
|---|---|---|
| AU | 40285/95 | 6/1996 |
| CH | 645798 | 10/1984 |

(Continued)

OTHER PUBLICATIONS

International Preliminary Examination Report corresponding to PCT/NZ2003/000282; mailed Feb. 17, 2004.

(Continued)

*Primary Examiner* — Lori Baker
(74) *Attorney, Agent, or Firm* — Foley & Lardner LLP

(57) ABSTRACT

A bath includes a water outlet or outlets arranged to in use direct a flow of water from behind onto the upper body of a bather or bathers sitting in the bath and leaning back against the wall of the bath. The upper body water outlet(s) may comprise two spaced water outlets one positioned to direct a water flow onto the left-side upper body of a bather and the other positioned to direct a water flow at the same temperature onto the right-side upper body of the bather.

19 Claims, 6 Drawing Sheets

(56) References Cited

U.S. PATENT DOCUMENTS

| | | | | |
|---|---|---|---|---|
| 5,537,696 | A | 7/1996 | Chartier et al. | |
| 5,548,854 | A | 8/1996 | Bloemer et al. | |
| 5,647,072 | A | 7/1997 | Shaffer et al. | |
| 5,682,625 | A | 11/1997 | Leaverton et al. | |
| 5,928,171 | A * | 7/1999 | Larsen | 601/148 |
| 6,092,246 | A | 7/2000 | Ludlow | |
| 6,182,303 | B1 | 2/2001 | Gardinier et al. | |
| 6,256,805 | B1 | 7/2001 | Ludlow et al. | |
| 6,289,529 | B1 | 9/2001 | Harvey | |
| 8,065,757 | B2 * | 11/2011 | Hatrick-Smith et al. | 4/538 |
| 2002/0053105 | A1 | 5/2002 | Turner | |
| 2003/0000009 | A1 | 1/2003 | Brennan et al. | |
| 2004/0148694 | A1 | 8/2004 | Brennan et al. | |
| 2007/0251001 | A1 | 11/2007 | Hatrick Smith et al. | |

FOREIGN PATENT DOCUMENTS

| | | | |
|---|---|---|---|
| CN | 2436076 | | 6/2001 |
| CN | 2457952 | | 11/2001 |
| DE | 3137406 | | 4/1983 |
| EP | 415058 | | 7/1990 |
| FR | 2677899 | | 12/1992 |
| JP | 5084267 | A | 4/1993 |
| JP | 5200079 | A | 8/1993 |
| JP | 9010272 | A | 1/1997 |
| JP | 2000139741 | A | 5/2000 |
| JP | 2002209967 | A | 7/2002 |
| JP | 2002238788 | A | 8/2002 |
| WO | WO9611661 | A1 | 4/1996 |
| WO | WO9801098 | A1 | 1/1998 |
| WO | WO00/62656 | | 10/2000 |
| WO | WO01/74223 | | 10/2001 |
| WO | WO2004/056248 | A1 | 7/2004 |

OTHER PUBLICATIONS

International Search Report corresponding to PCT/NZ2003/000282; mailed Mar. 9, 2004.

International Search Report corresponding to PCT/NZ2004/000266, mailed Feb. 25, 2005.

European Examination Report for EP Application No. 04 793 730. 5-1255; dated Mar. 21, 2012; 5 pages.

* cited by examiner

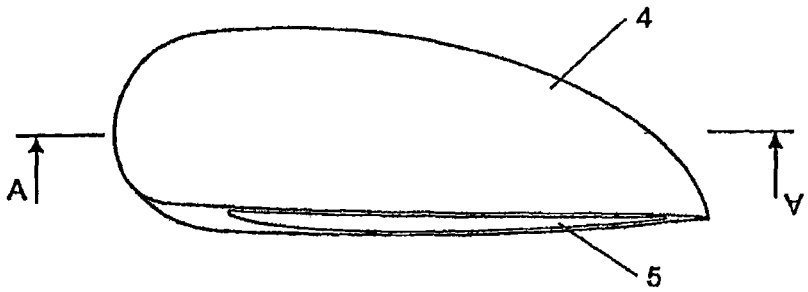
FIGURE 4
FIGURE 5
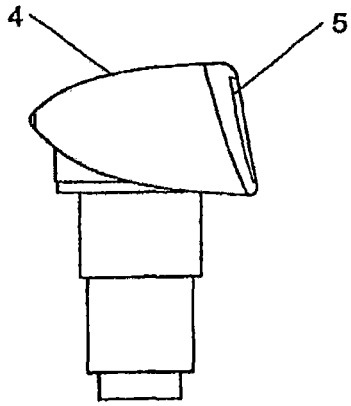
FIGURE 6
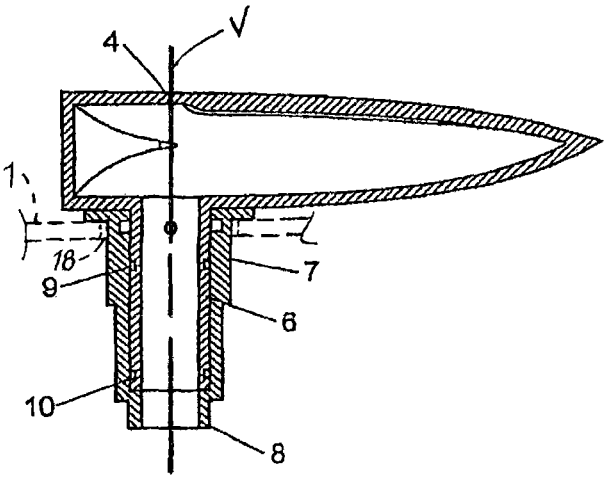

BATH

CROSS-REFERENCE TO RELATED PATENT APPLICATIONS

This application is a Divisional of U.S. patent application Ser. No. 10/539,760, filed Feb. 8, 2006, which is the national stage entry of PCT/NZ2003/000282, filed Dec. 22, 2003, which claims priority to New Zealand Application No. 523321, filed Dec. 20, 2002, the disclosures of which are incorporated herein by reference in their entirety.

BACKGROUND

The invention comprises an improved form of bath.

A standard bath is filled with generally warm water, from taps or a mixer and spout, and is used for bathing.

A spa bath typically incorporates an intake and a number of spa jets positioned in the bath side walls, and piping around the exterior of the bath, through which water is circulated from an intake to the jets in the side walls of the bath by one or more pumps. A spa bath provides the bathes) with a more luxuriant bathing experience.

SUMMARY

It is an object of the invention to provide an improved or at least alternative form of bath, which further adds to the bathing experience.

In broad terms in one aspect the invention comprises a bath including a water outlet or outlets arranged to in use direct a flow of water onto the upper body of a person or persons sitting in the bad and lea back against a wall or walls of the bath, and a pump and water recirculation system arranged to recirculate a flow of water from the bath through said upper body water outlets onto the shoulders of a bather or bathers in the bath.

In broad terms in another aspect the invention comprises a bath including an end wall section which is approximately convexly curved over at least a part of the height of the wall section and which includes a water outlet on one side of the wall section and another water outlet on another side of the wall section, both of which water outlets are arranged to in use direct a flow of water onto the shoulders and/or neck of a person sitting in the bath leaning against the curved wall section of the bath.

In broad terms in another aspect the invention comprises a bath including an end wall section and upper body water outlets arranged to direct a flow of water from behind onto the shoulders and/or neck of a bather sitting in the bath leaning against the curved wall section of the bath, said upper body water outlet(s) comprising two spaced upper body water outlets one positioned to direct a water flow onto the left-side of a bather and the other positioned to direct a water flow at the same temperature onto the right-side upper body of the bather, said left and right side upper body water outlet fittings being pivotally mounted enabling a bather sitting in the bath to adjust the direction of the water flow from the fittings onto the bathe upper body, each fitting having a hollow interior and a hollow mounting neck by which the fitting is pivotally mounted in an aperture. In the top of the bath wall or in a rim around the top of the bath wall.

In the bath of the invention, water outlets are provided which are positioned to direct a flow of water, typically warm bath water recirculated by a pump, onto the shoulders of a bather or bathers in the bath. It is generally envisaged that two spaced water outlets will be provided in some form, one positioned so that in use it will direct a water flow onto the left-side upper body of the bather and the other positioned so that it will direct a water flow onto the right-side upper body of the bather. However in an alternative form a single water outlet may for example be arranged to direct a wide flow of water across the neck and shoulders region of a bather, from behind. Instead of being recirculated warm bath water, the water flow may be fresh ie non-recirculated water, which is preferably warmed by a water heater.

A standard (single person) bath may include upper body water outlets at one end of the bath only. A bath designed to accommodate two persons sitting in the bath against opposite ends of the bath may incorporate upper body water outlets at both ends of the bath. A bath designed to accommodate two persons sitting side by side may incorporate side by side upper body water outlets arranged to direct water onto the upper body of both bathers. A spa bath or pool designed to accommodate up to three or more persons may incorporate upper body water outlets in accordance with the invention at a number of seating positions around the bath or pool. In this specification the term "bath" is intended to also include spa baths and spa pools, including and also known as spas, whirlpools, and jacuzzis.

Typically the upper body water outlets will be positioned in a junction portion of the bath which joins a wall section of the bath which defines the bath cavity, with a surrounding rim section around the bath cavity. Where two spaced upper body water outlets are provided to direct water flows on to the left and right-sides of a bather or bathers, typically the junction portion between the bath wall section and surrounding rim section will between the upper body water outlets be a smooth joining portion shaped so that it is comfortable for the neck or head of a bather to rest against. Alternatively or additionally the bath may incorporate a pillow formed of a compressible material such as synthetic foam which is positioned between the upper body water outlets to give added comfort to a bather. In a further form of the invention the upper body water outlets may be integral with such a pillow as will be further described. In another form of the invention the upper body water outlets may be positioned on the generally horizontal rim section around the bath cavity or in recesses in such a rim section. The outlets maybe arranged to direct an arching and preferably laminar flow of water onto the upper body or bodies of a bather or bathers.

BRIEF DESCRIPTION OF THE DRAWINGS

The invention is fiber illustrated by the following description of embodiments of baths of the invention, which are described by way of example and without intending to be limiting. In the drawings:

FIG. 4 is a view from above of one of the pivotable upper body water outlets of the bath of FIGS. 1 to 3, FIG. 5 is a view of the upper body water outlet of FIG. 4 from one end, FIG. 6 is a cross-section view of the upper body water outlet of FIG. 4 along line A-A of FIG. 34.

DETAILED DESCRIPTION

Figure 1:
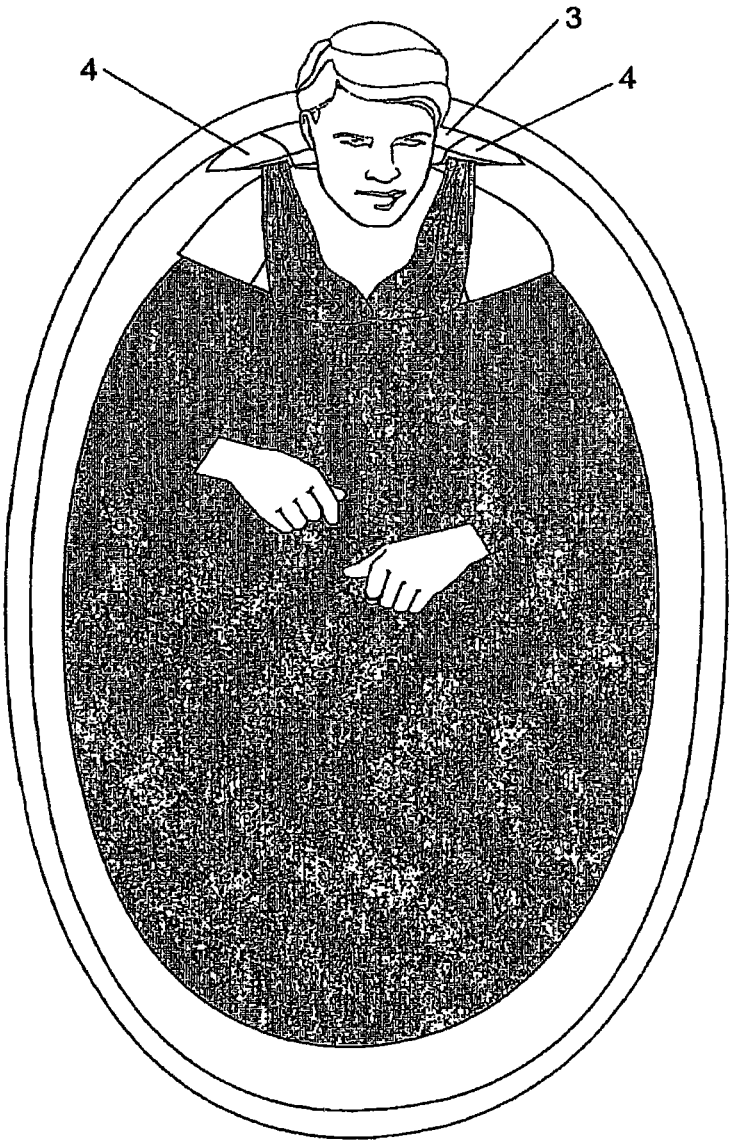
FIG. 1 is a view from above showing one form bath of the invention, with a user therein.
Figure 2:
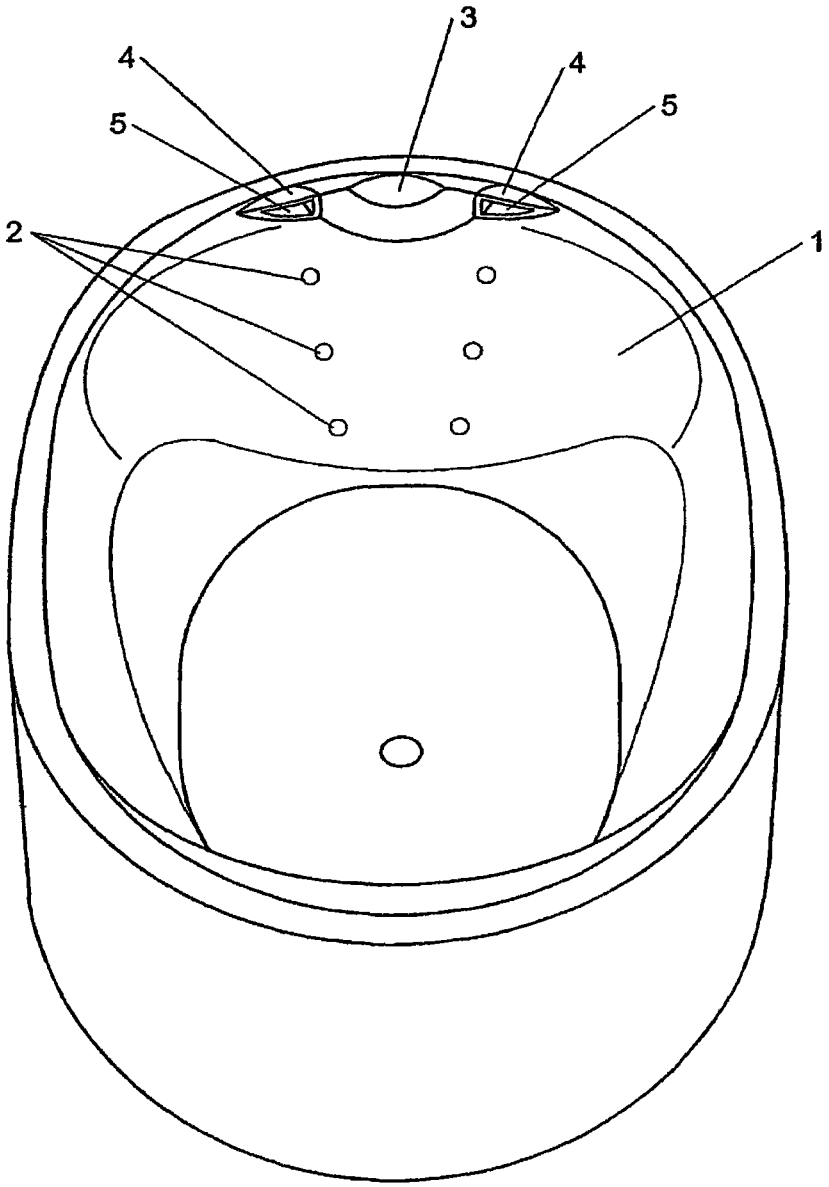
FIG. 2 is a view from above one end of the bath of FIG. 1 when empty.

Referring to FIGS. 1 to 3, the bath shown therein is a spa bath and incorporates a suction inlet from which water is drawn and a number of spa outlets or jets from which water is pumped back into the bath. The bath has one or more wall sections 1 which are shaped so as to be comfortable for bathers sitting in the bath and leaning back against the wall of the bath. The bath may include water outlets 2 in the curved wall sections 1 as shown in FIG. 2 which direct water against the back of the bather.

At the top of wall sections 1 is optionally provided a pillow 3 which is moulded from a synthetic foam material, and on either side of the pillow are mounted left and right upper body water fittings 4 including outlets 5, which are also connected to the spa pump or pumps so that they will in use direct a flow of water onto the upper body of a bather sitting in the bath, on both the left and right sides as shown in FIG. 1. Preferably the fittings 4 provide water outlets 5 which are elongate in shape as shown so that the flow of water from each outlet 5 is wider than it is deep, or laminar, so that when the water flows impact the shoulder and/or neck regions of a bather they will cover and warm as much of the bathers upper body exposed above the water in the bath, as possible. Alternatively however the outlets 5 may comprise a number of smaller elongate or circular outlets for example.

Figure 3A:
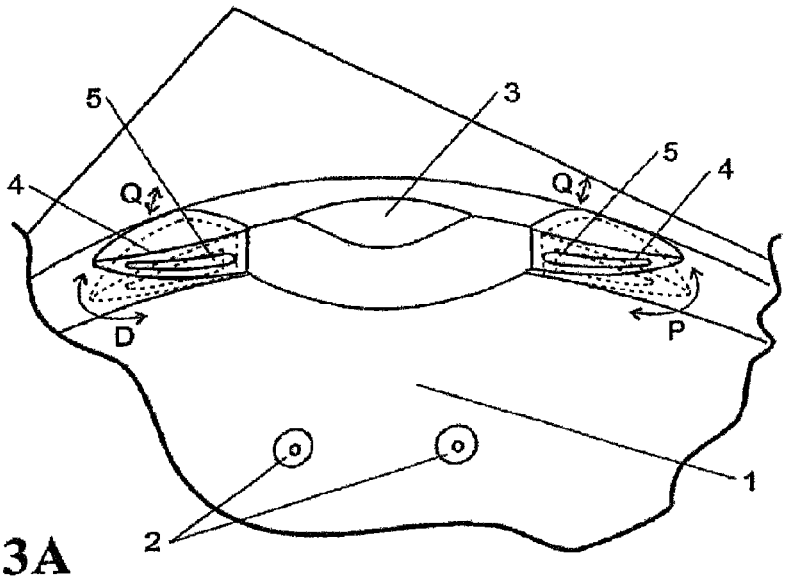
FIGS. 3A and 3B are close up views of the upper body water outlets of the bath of FIG. 1 positioned on either side of a neck pillow.
Figure 3B:
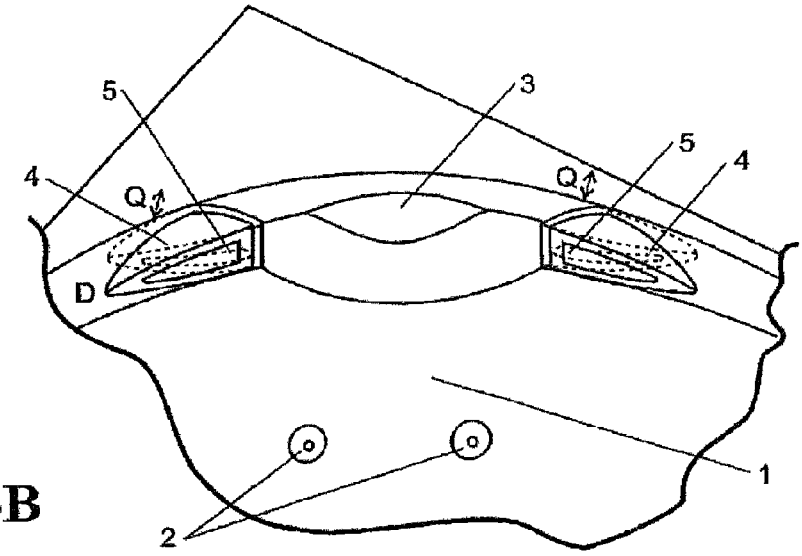

In the bath shown in FIGS. 1 to 3 the upper body water fittings 4 can pivot in the direction of arrows P and/or Q (if both, then through an approximate quadrant arc) as shown in FIGS. 3A and 3B, which enables a bather sitting in the bath to perfect the aim of the water flow onto the bathers upper body.

FIGS. 4 to 6 show a single fitting 4. The fitting which is elongate in shape between two ends and has a hollow interior and also has a hollow mounting neck 6 extending from closer to one end of the fitting than an opposite end which is in turn carried in a tubular collar 7 fixed in an aperture 18 in the bath wall 1 (shown in phantom in FIG. 4), so that a user can pivot the fitting 4 by pushing or pulling the top of the fitting, causing the fitting to rotate in the tubular collar 7 about a generally upright axis V along the fitting 4. A pipe (not shown) from the water pump of the bath or alternatively a separate pump, connects to the lower end 8 of the tubular collar 7 and O-rings at 9 and 10 seal between the mounting neck 6 and the tubular collar 7.

In an alternative form upper body water outlet fittings similar to those shown in FIGS. 1-6 may be fixed rater than having the ability to be pivoted by a bather as described. Such fixed fittings may be formed separately from the bath wall or alternatively may be formed as integral shaped moulded portions of the bath wall and/or rim section around the top of the bath wall.

Figure 7:
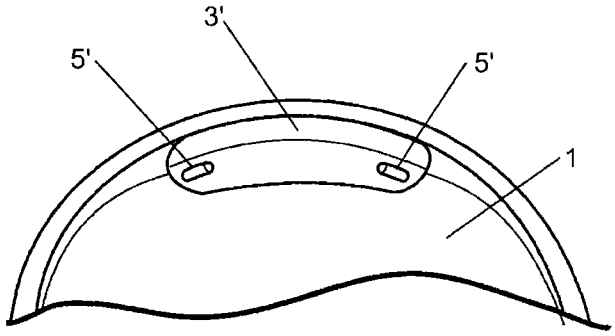
FIG. 7 shows another form of bath of the invention in which upper body water outlets are integral with a neck-pillow.

FIG. 7 shows another form of bath of the invention in which neck-shoulder water outlets 5 are integral with a neck-pillow 3. The neck pillow may be of any desired shape. Apertures through a removable moulded foam pillow may align with water outlets through the wall or horizontal rim of the bath. Optionally the neck pillow including the water outlet apertures 5 may be covered with an open weave material such as a LYCRA™ material which will at least partially conceal the water outlets 5 without significantly interrupting the water flow in use. In another form pivotable neck-shoulder water outlets 5 as in the bath of FIGS. 1 to 3 may comprise flexible wings or ears of a pillow by being over-moulded with moulded foam material from which the pillow 3 is formed. Alternatively the pivotable neck-shoulder water outlets 5 as in FIGS. 1 to 3 may be non-integral with the pillow 3 i.e. separate components, but still be over-moulded or covered with a softer synthetic material.

Figure 8:
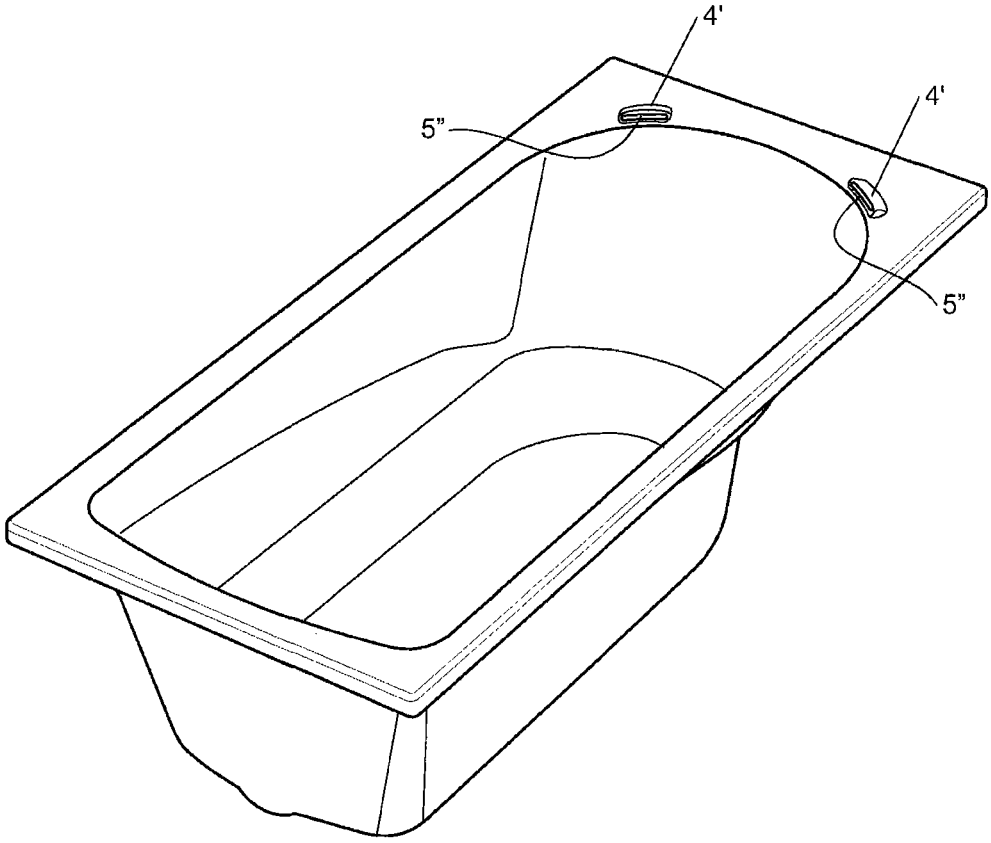
FIG. 8 shows a bath of the invention with upper body water outlets mounted in a surrounding rim section of the bath.

FIG. 8 shows a bath of the invention with neck-shoulder water outlets 5 in fittings 4 mounted in an upper rim section of the bath. The outlets 5 are again positioned so that they will in use direct a flow of water on to the upper body of person sitting in a bath leaning against the curved wall section 1 of the bath.

Figure 9:
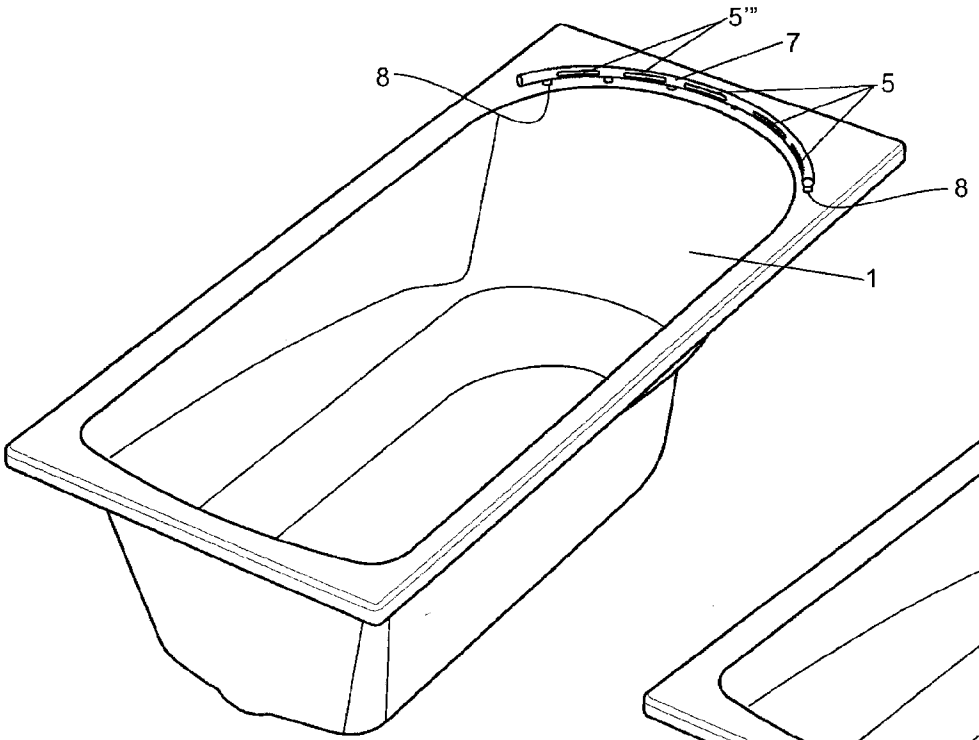
FIG. 9 shows a bath in which a single fitting around a curved end wall of a bath provides upper body water outlets which direct a wide flow of water onto the shoulders and neck of a bather.

FIG. 9 shows a bath of the invention in which a single tubular fitting 7 around curved end wall 1 of the bath provides neck-water outlets 5 as shown. The tubular fitting may be a chromed fitting for example. It may be mounted to the upper rim section of the bath by short upright tubes 8 through which water is supplied to the interior of the tube 7. The outlets 5 in the tube 7 may comprise a series of slot outlets around approximately the full length of the tube 7, or slot outlets on either side only, or the outlets may be formed as a series of non-slot shaped apertures.

Figure 10:
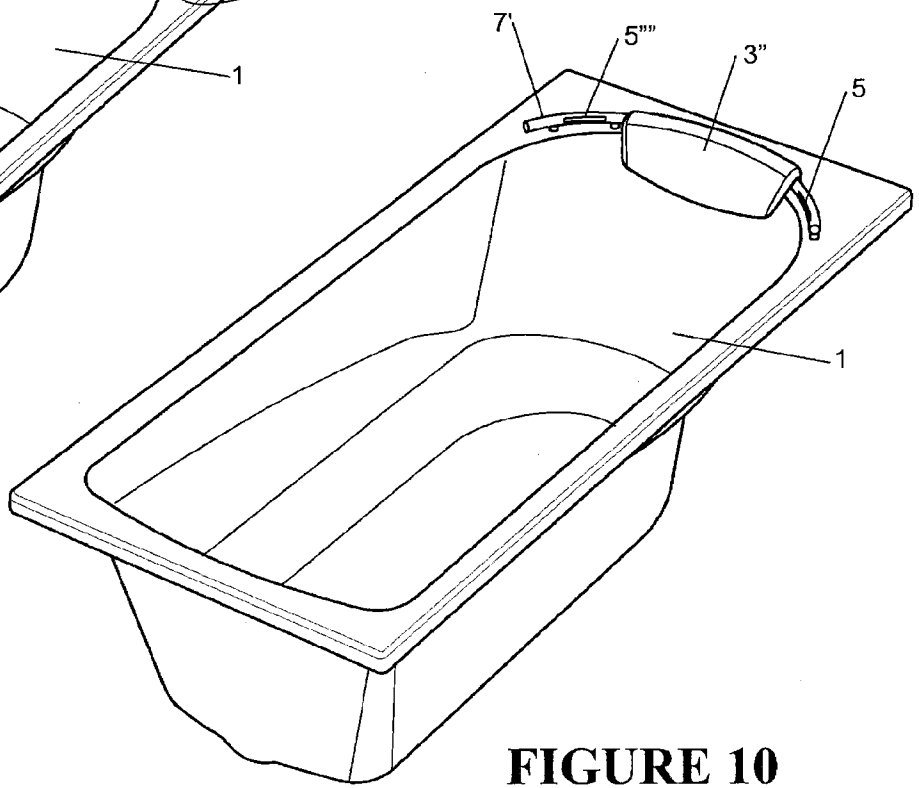
FIG. 10 shows a bath of the invention similar to that of FIG. 9 in which a single fitting around a curved end wall of a bath provides upper body water outlets and also supports a neck pillow

FIG. 10 shows a bath similar to that of FIG. 9 in which a similar curved fitting 7 around the upper rim section of the bath also supports a moulded foam pillow 3, and provides neck-shoulder water outlets 5 which direct a laminar flow of water onto the shoulder regions and also neck of a bather.

The foregoing describes the invention including a preferred forms thereof Alterations and modifications as will be obvious to those skilled in the art are intended to be incorporated in the scope hereof.

What is claimed is:

1. A bath comprising:

a wall section; and a tubular fitting disposed generally above the wall section;

wherein the tubular fitting includes one or more outlets configured to direct water to a shoulder region or neck region of a bather leaning against the wall section; and wherein one or more of the outlets is an aperture extending through a radial surface of the tubular fitting.

2. The bath according to claim 1, wherein the wall section is curved, and the tubular fitting is curved so as to generally follow the curvature of the wall section.

3. The bath according to claim 1, wherein the wall section includes an upper rim section, and the tubular fitting is mounted to the upper rim section.

4. The bath according to claim 3, wherein the tubular fitting is mounted to the upper rim section with one or more upright tubes configured to supply water to the tubular fitting.

5. The bath according to claim 3, wherein the tubular fitting is generally horizontal and is spaced above the upper rim section.

6. The bath according to claim 1, wherein one or more of the outlets is an elongate slot that extends through a radial surface of the tubular fitting.

7. The bath according to claim 1, wherein the one or more outlets include a plurality of apertures distributed between left and right sides of the tubular fitting.

8. The bath according to claim 1, wherein:

the one or more outlets include a first aperture and a second aperture;

the first aperture is positioned on a left side of the tubular fitting and is configured to direct water onto a left shoulder region of the bather; and the second aperture is positioned on a right side of the tubular fitting and is configured to direct water onto a right shoulder region of the bather.

9. The bath according to claim 8 further comprising a pillow, wherein the pillow is positioned generally between the first aperture and the second aperture.

10. The bath according to claim 9, wherein the pillow is supported by the tubular fitting.

11. The bath according to claim 9, wherein the pillow comprises a molded foam material.

12. The bath according to claim 9, wherein the pillow includes one or more pillow apertures aligned with one or more of the apertures of the tubular fitting.

13. The bath according to claim 8, wherein the one or more apertures include a third aperture positioned on a central portion of the tubular fitting to direct water onto a neck region of the bather.

14. The bath according to claim 13, further comprising a pillow, wherein the pillow includes one or more apertures aligned with the third aperture of the tubular fitting.

15. The bath according to claim 14, wherein the pillow includes a cover configured to at least partially conceal the third aperture of the tubular fitting.

16. The bath according to claim 1, wherein the tubular fitting is connected to a pump.

17. A tubular fitting for a bath comprising:

one or more apertures extending through a radial surface thereof;

wherein the tubular fitting is configured to be connected to a pump; and wherein the tubular fitting is configured to be mounted generally above a wall section of the bath, the one or more apertures configured to distribute water onto a shoulder or neck region of a bather seated against the wall section.

18. The tubular fitting of claim 17, wherein the tubular fitting is configured to be spaced above an upper rim section of the bath.

19. The tubular fitting of claim 17, wherein the tubular fitting is curved to generally follow a curvature of the wall section of the bath.

* * * * *